United States Patent [19]

Pierpoint

[11] Patent Number: 4,769,903

[45] Date of Patent: Sep. 13, 1988

[54] CORD FILLER REMOVER AND METHOD

[75] Inventor: James W. Pierpoint, Winston-Salem, N.C.

[73] Assignee: Automated Systems & Devices, Inc., Winston-Salem, N.C.

[21] Appl. No.: 902,425

[22] Filed: Aug. 29, 1986

[51] Int. Cl.[4] ..... H01R 43/00

[52] U.S. Cl. ..... 29/825; 28/168; 134/15

[58] Field of Search ..... 28/168, 170; 134/15; 432/8, 59, 222; 156/344; 29/825; 34/107; 219/364, 370, 373, 374

[56] References Cited

U.S. PATENT DOCUMENTS

| | | | |
|---|---|---|---|
| 2,291,862 | 8/1942 | Bailey . | |
| 2,432,868 | 12/1947 | Earl et al. . | |
| 2,450,948 | 10/1948 | Foster | 28/168 X |
| 3,342,638 | 9/1967 | Wanzenberg . | |
| 3,374,117 | 3/1968 | Savage . | |
| 3,635,454 | 1/1972 | Angelo et al. | 134/15 X |
| 3,749,602 | 7/1973 | Mosier . | |
| 4,388,142 | 6/1983 | Hembert | 29/825 X |

FOREIGN PATENT DOCUMENTS

| | | | |
|---|---|---|---|
| 2065187 | 11/1972 | Fed. Rep. of Germany | 28/168 |
| 1339815 | 12/1973 | United Kingdom | 28/168 |

*Primary Examiner*—Timothy V. Eley
*Assistant Examiner*—Carl J. Arbes

[57] ABSTRACT

A device and method is presented for removing filler from electrical cords or the like comprising a heater, a nozzle for directing a thin stream of heated air against the filler, and a pulse generator is provided whereby cord filler is degraded by heat and ejected from the cord by a pulse of high pressure air.

14 Claims, 8 Drawing Sheets

CORD FILLER REMOVER AND METHOD

BACKGROUND OF THE INVENTION

1. Field of The Invention

The present invention relates to a device and method employing forced hot air for use in removing selected sections of filler material from electrical cords after the outer sheath of insulation is removed.

2. Description of the Prior Art And Objective Of The Invention

Conventional electrical cords are formed from a variety of substances and in a variety of configurations yet many utilize a filler material which is non-conductive and is used to separate wires or conductive surfaces within the electrical cord. Typically, an electrical cord is constructed having an outer sheath of a non-conductive material such as a polyvinyl chloride (PVC). Within this outer covering or sheath is a plurality of electrical wires which may be individually covered with PVC or other non-conductive coatings but may still require filler for insulation, protection from abuse and to provide the desired strength and rigidity for the completed cord. While the filler serves useful purposes the cord is generally manufactured in long, continuous lengths and when it arrives at assembly plants for use on appliances or the like, the cord must be cut to a desired approximate length and thereafter the conducting wires within must be stripped for attachment to their designated connections. This stripping procedure is generally done by hand and is a time consuming and laborious task which adds significant cost to the finished product. One of the main problems in stripping cords is in removing the filler material therefrom. Such filler materials are oftentimes formed from synthetic fibers such polypropylene, jute, paper or other generally low cost materials. Removing the outer sheath from the cord is a relatively simple procedure since the sheath can be cut to a uniform depth, however the filler material is often interwined with the conducting wires and therefore must be hand separated and then carefully severed from the cord. As certain synthetic fillers generally consist of a plurality of threads, such hand separation often omits certain of the threads whereby these missed threads cause problems and concern during later steps of cord attachment to connectors, terminals or other devices.

With the disadvantages and problems arising from prior art methods of removing fillers, the present invention was conceived and one of its objectives is to provide a safe and complete method and device for quickly and efficiently removing fillers from electrical cords.

It is another objective of the present invention to provide a filler remover device which is relatively easy to operate and which will allow the removal of various filler materials from a variety of cord configurations.

It is yet another objectives of the present invention to provide a filler remover device which can be successfully operated with very little training and yet will provide complete, uniform filler removal.

It is still another objective of the present invention to provide a method for filler removal from electrical cords in which a pulse generator applies a high pressure blast to a cord in which the filler has been somewhat degraded to finally and completely remove the filler therefrom.

Various other objectives and advantages of the present invention become apparent to those skilled in the art as a more detailed explanation of the invention is set forth below.

SUMMARY OF THE INVENTION

The aforesaid and other objectives are realized by a cord filler remover device and method in which ambient air at approximately 5 psi or less is directed through a fan conduit and into an adjustable temperature heater where the temperature is substantially raised to approximately 200°–700° C. The air travels then through the heater and into a nozzle having a lateral opening along its upper surface. A cord guide positioned near the nozzle opening allows the user to place the cord with a portion of the outer sheath removed into the hot air stream passing from the nozzle opening whereby the filler is acted on and degraded by the hot air stream and is removed. A hand rest which incorporates an air curtain induces ambient air across the cord guide to prevent the operator from being burned by the high temperture air which flows from the nozzle. Upon activation a pulse generator provides a blast of high pressure air through the heater and nozzle during the later stages of filler degradation which impacts the filler, causing it to separate and be blown upwardly, away from the cord. A safety housing is positioned over the nozzle to provide a back-catch for the filler shards thus preventing contact and injury to the operator.

DESCRIPTION OF THE PREFERRED EMBODIMENTS OF THE INVENTION

Figure 1:
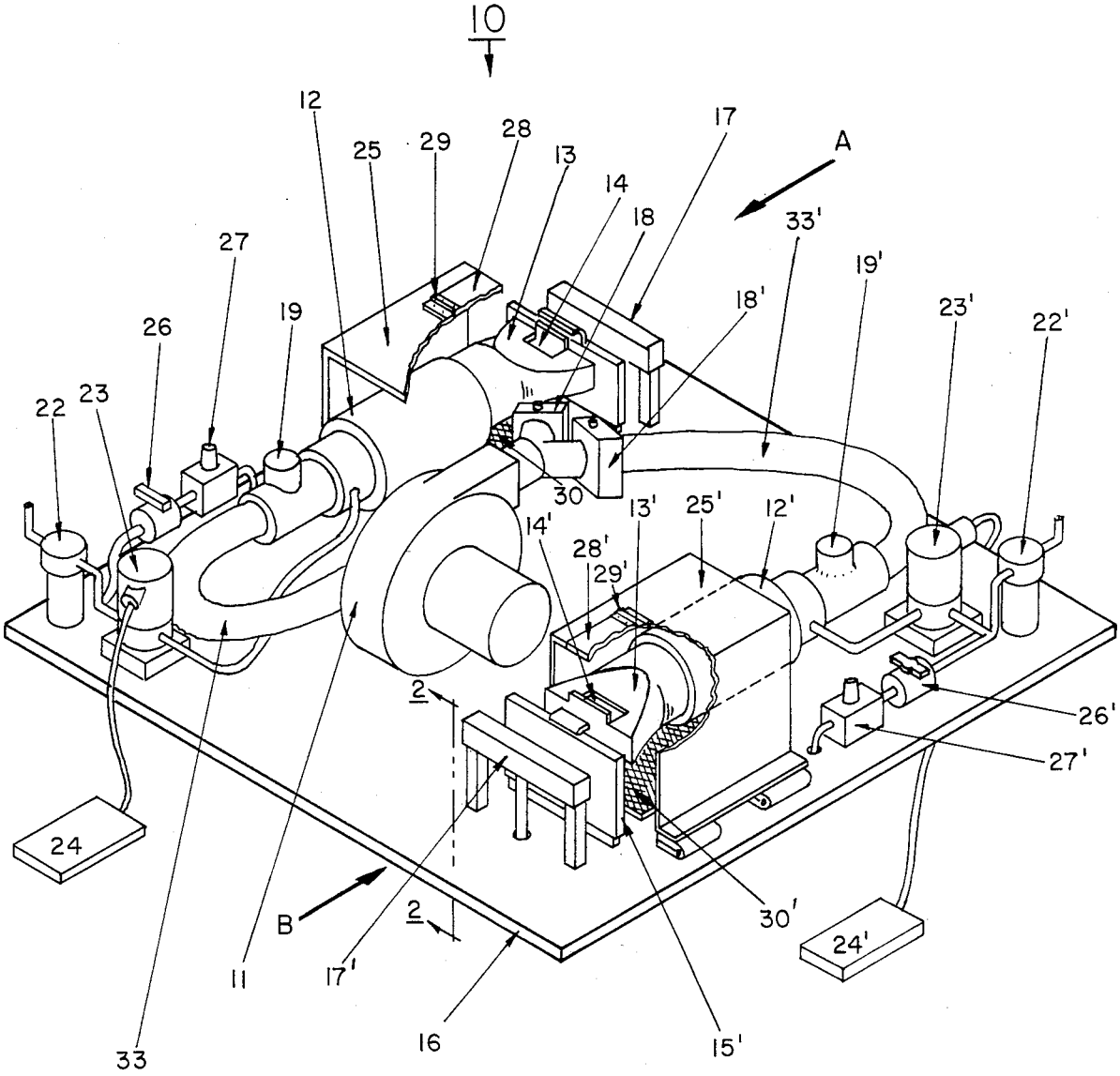
FIG. 1 shows in perspective fashion a cord filler remover device of the dual station type.

As shown with dual stations in FIG. 1, the device for removing filler from cords comprises an air heating means in the form of an electrical resistance heater and a nozzle which is joined to the heater for directing a relatively thin stream of hot air upwardly across an electrical cord having a portion of its outer sheath removed, exposing the filler. Conduits from the fan provide air to the heaters at approximately 1 psi. A pulse generator including an air compressor delivers air first through an air filter and then through a solenoid valve to provide a pulse of air at approximately 80 psi into the heater and out the lateral opening in the nozzle. This pulse of air provides a sharp impact to the cord to thus blast away polypropylene filler which has previously been degraded by the 1 psi hot air passing through the lateral nozzle opening. A foot pedal is provided to activate the pulse generator during the later stages of heating said filler with hot, low pressure air.

The preferred method of the invention comprises the directing of heated air upwardly through a lateral opening in the nozzle; placing a cord with its sheath partially removed containing filler in the heated air as it passes from the lateral opening whereby the heat destroys the structural integrity of the filler. Thereafter striking the heated filler with a sudden impulse of high pressure hot air causes the degraded filler to separate from the cord leaving the conducting wires available for attachment to an appliance or the like.

DETAILED DESCRIPTION OF THE DRAWINGS AND OPERATION OF THE INVENTION

With reference to drawing FIG. 1, cord filler remover device is depicted having dual stations (A,B) whereby two operators can simultaneously remove fillers from electrical cords or the like, Centrifugal fan 11 directs ambient air approximately 1 psi into fan couplers 18 and 18' and on into respectively conduits 33 and 33' which supply air respectively to filler removal stations A and B. Only one such operation or station will be described in detail below although as understood from FIG. 1 cord filler apparatus 10 consists of substantially two (2) such stations.

Following the air flow through conduit 33' in FIG. 1, check valve 19' is encountered which remains normally open allowing the ambient air to pass into adjustable temperture heater 12' which has a series of electrical resistance heater coils therein. This low pressure air is heated to approximately 200°–700° C. in heater 12'. Air passing through heater 12' then flows into nozzle 13' and exits lateral slot 14' in an upward direction. Safety housing 25' is positioned above lateral opening 14' whereby shards of filler will collect on the underneath side of debris gate 28' and can be removed therefrom from time-to-time as necessary. As the heated air emerging from lateral opening 14' encounters a typical filler material such as polypropylene, it has been generally found that the heated air does not provide total removal and a pulse of somewhat cooler air under high pressure is needed to complete the filler removal. Thus, a pulse generator 20' (FIG. 5) consisting of a air compressor 21 (not shown in FIG. 1), filter 22' and a solenoid valve 23' provides a source of high pressure air which is warmed as it passes through heater 12' and will provide as sharp impact to a cord filler positioned over opening 14'.

Figure 5:
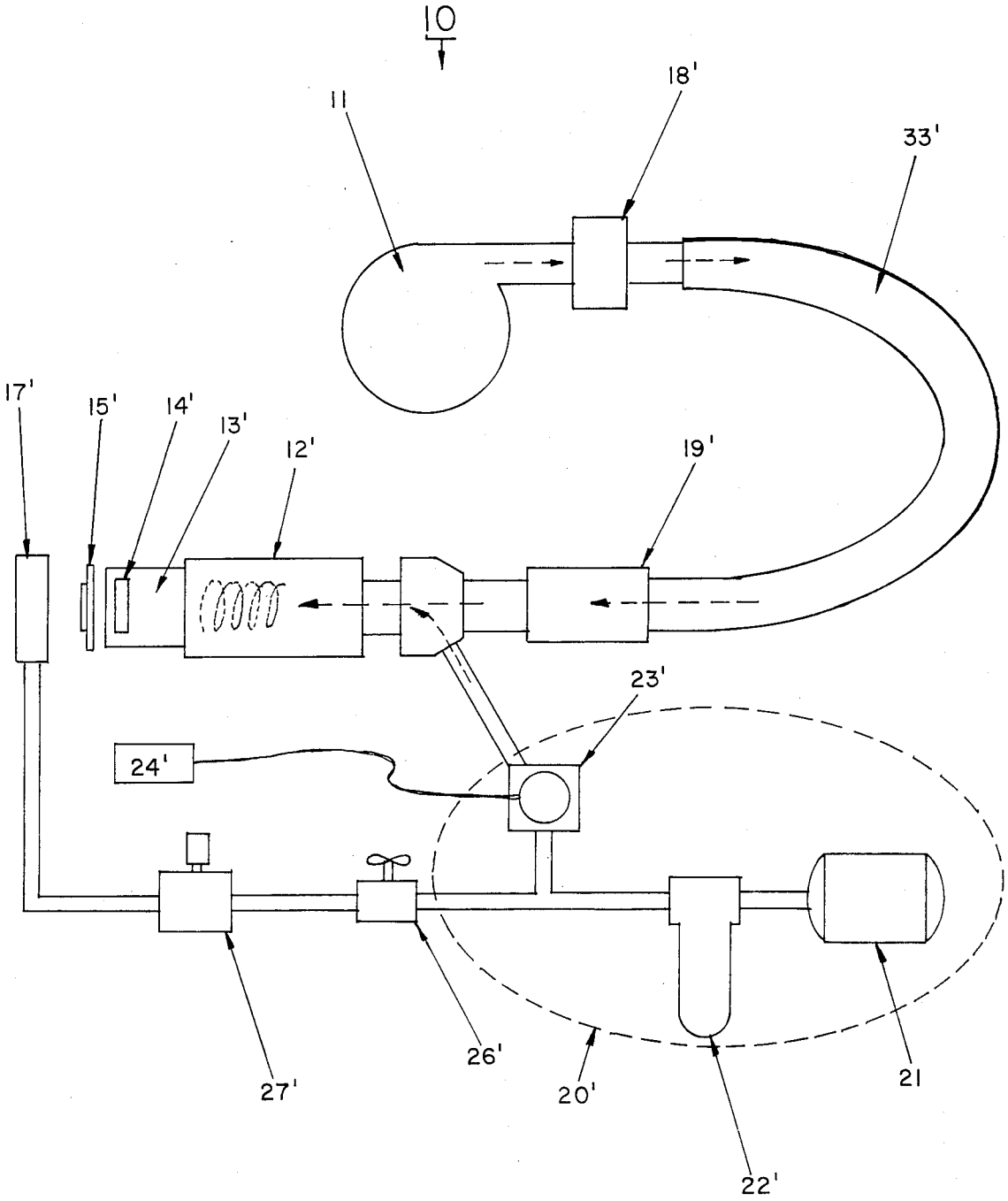
FIG. 5 pictures a schematic flow diagram of a single station filler remover device.

When pulse activating means 24' in the form of a foot panel is depressed, solenoid valve 23' allows 5 to 100 psi air to pass from filter 22' to heater 12' and out lateral opening 14' in nozzle 13'. Check valve 19' is normally open to allow 1 psi air to move from fan 11 to heater 12'. However, once pulse activating means 24' is depressed, check valve 19' closes whereby air passing through electric solenoid valve 23' is directed forwardly, through lateral opening 14'. Once pressure is removed from pulse activating means 24', check valve 19' returns to its normally open position and solenoid 23' returns to its normally closed position. As shown in FIG. 5, air moves from compressor 21 through ball valve 26', flow control valve 27' and through hand rest means 17' acts as a cold air curtain and hand support while holding cord 50 in positions shown in FIGS. 3A, 3B and 3C. This air curtain induces air towards cord rest 15' as shown in FIG. 1 to protect the operator's hand on rest means 17'.

Figure 2:
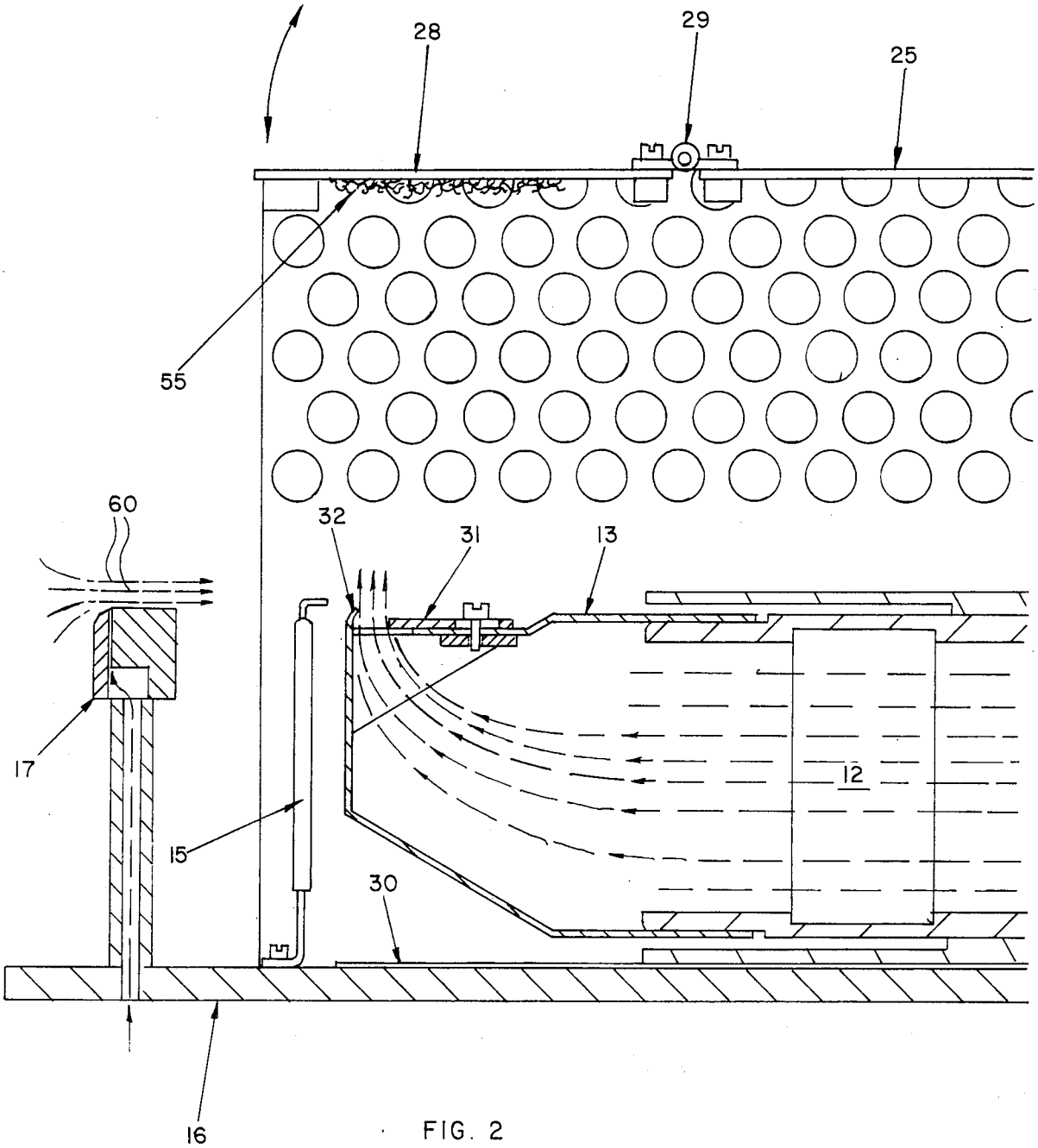
FIG. 2 illustrates a close-up cross-sectional view of the nozzle and safety housing along lines 2—2 of FIG. 1.

Safety housing 25 as shown in FIG. 2 protects the operator from shards of filler which are removed from the cord and debris gate 28 which is pivotally attached to safety housing 25 by gate hinge 29 serves as a collection area for shards 55 which collect on the underneath side of debris gate 28. Induced air flow directional arrows 60 show the stream of air created by the air passing over hand rests means 17 towards cord guiding means 15.

Figure 3A:
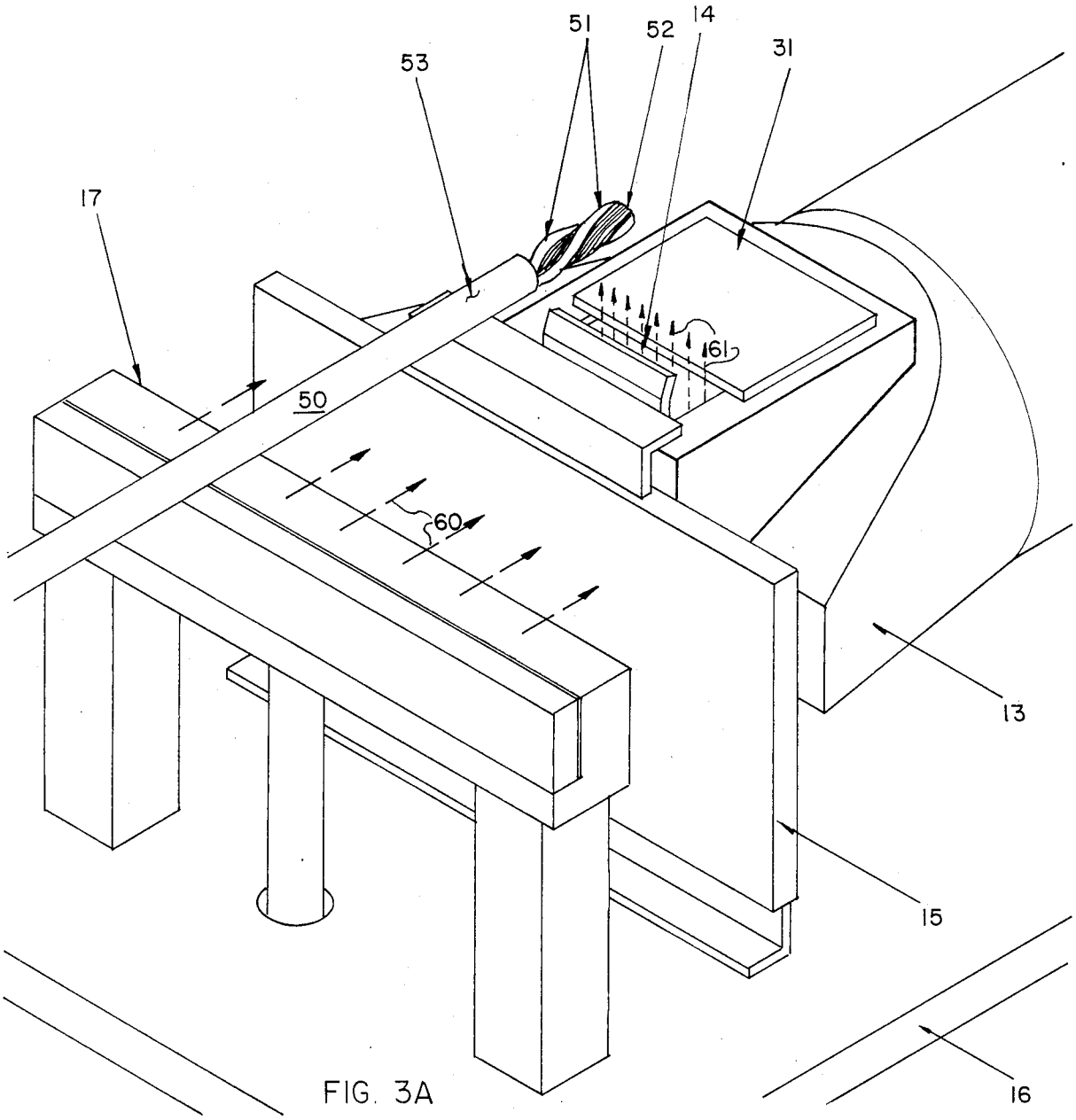
FIG. 3A demonstrates an enlarged view of a cord immediately prior to entry into the hot air steam.

As further shown in FIG. 1, nozzles 13 and 13' have positioned thereunder a base insulation mat 30, 30' which may be formed of fiberglass or other suitable insulating materials to prevent base 16 from becoming overheated. Base 16 may consists of aluminum or otherwise and may be mounted at a convenient height on a table or with supporting legs as required, convenient to the operators FIG. 3A, 3B and 3C demonstate in sequence a typical method of removing filler 52 from an electrical cord 50. The method comprises directing heated air (arrows 61) through lateral opening 14 of nozzle 13 as shown in FIG. 3A. Cord 50 has had a portion of outer sheath 53 stripped approximately 1 inch in length thereby exposing vinyl clad conductors 51 which have filler 52 wrapped between. Filler 52 consists of a plurality of polyproplylene fibers, which by choice may be of other synethetic or natural materials. As seen in FIG. 3A cord 50 is aligned with lateral opening 14 whereby outer cord insulation 53 is placed immediately beyond lateral opening 14. In this position all of exposed filler 52 will be removed. As earlier mentioned, hand rest means 17 acts as a cool air curtain and induces the flow of ambient air along cord 50 towards nozzle 13. This induced air flow prevents the heated air (as illustrated in FIG. 3A by arrows 61) from burning or irritating the operator's hand.

Figure 3B:
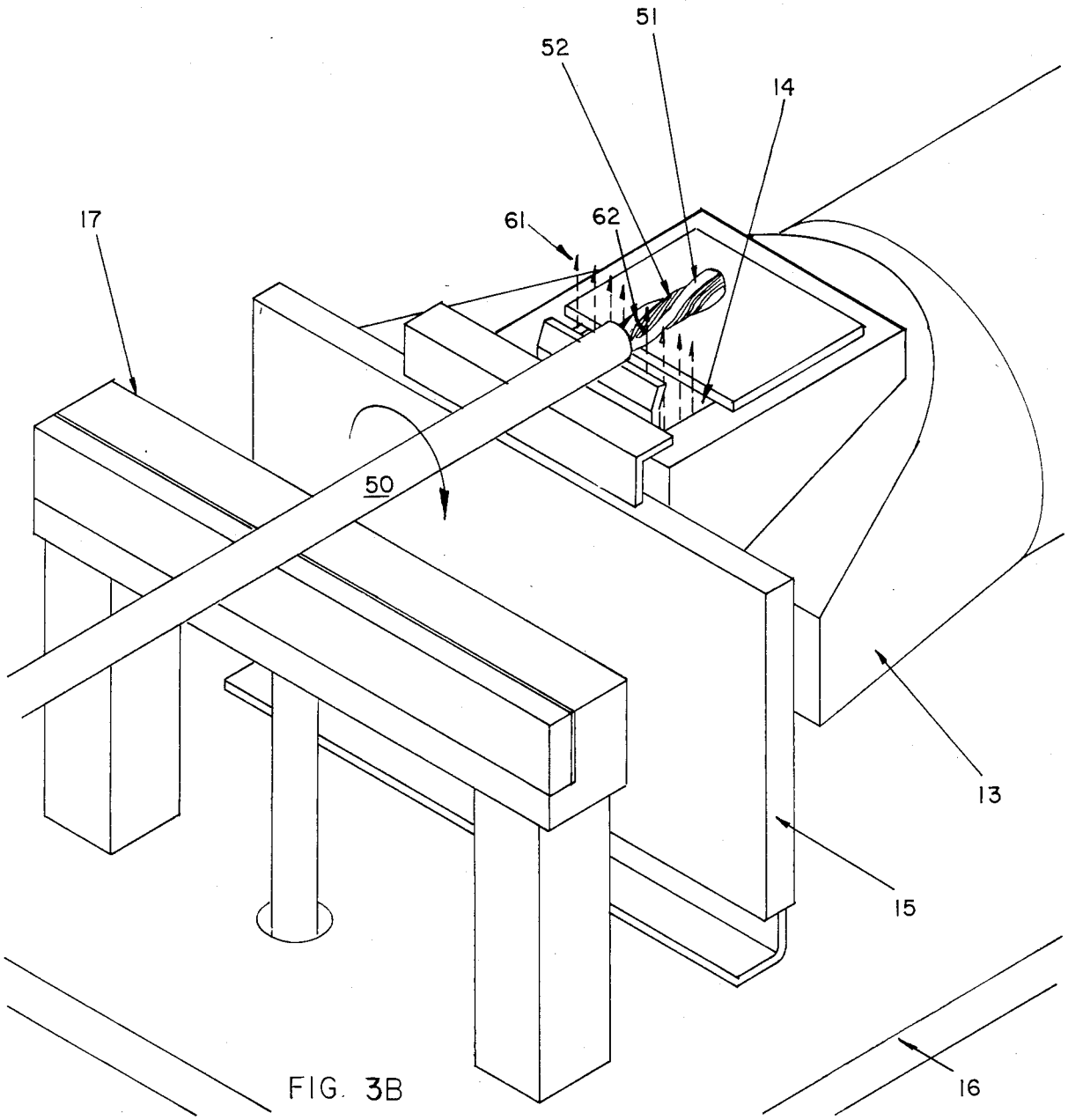
FIG. 3B shows the cord as depicted in FIG. 3A as being rotationally advanced into the hot air steam.
Figure 3C:
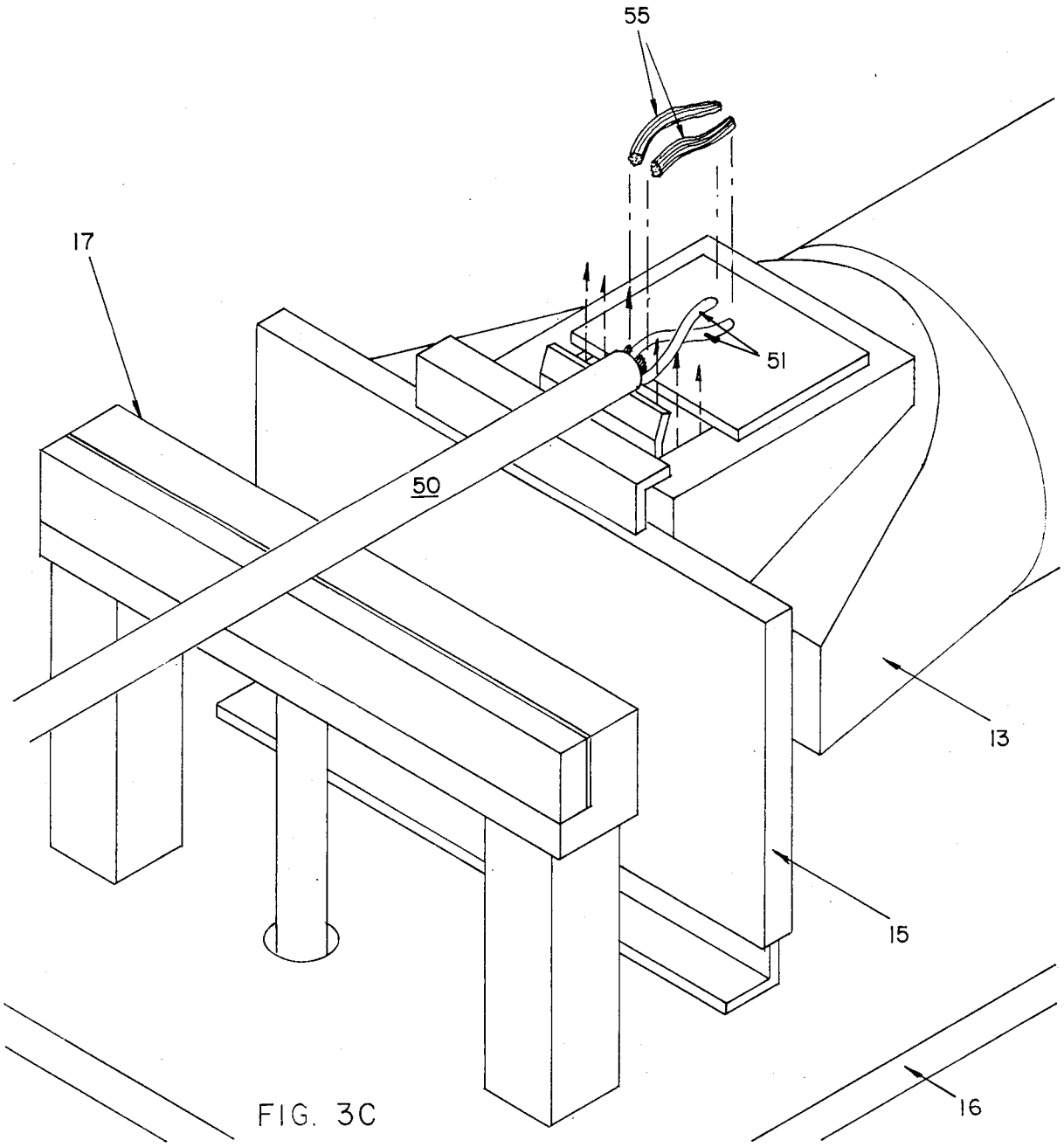
FIG. 3C depicts the cord with the filler shards removed therefrom.
Figure 3D:
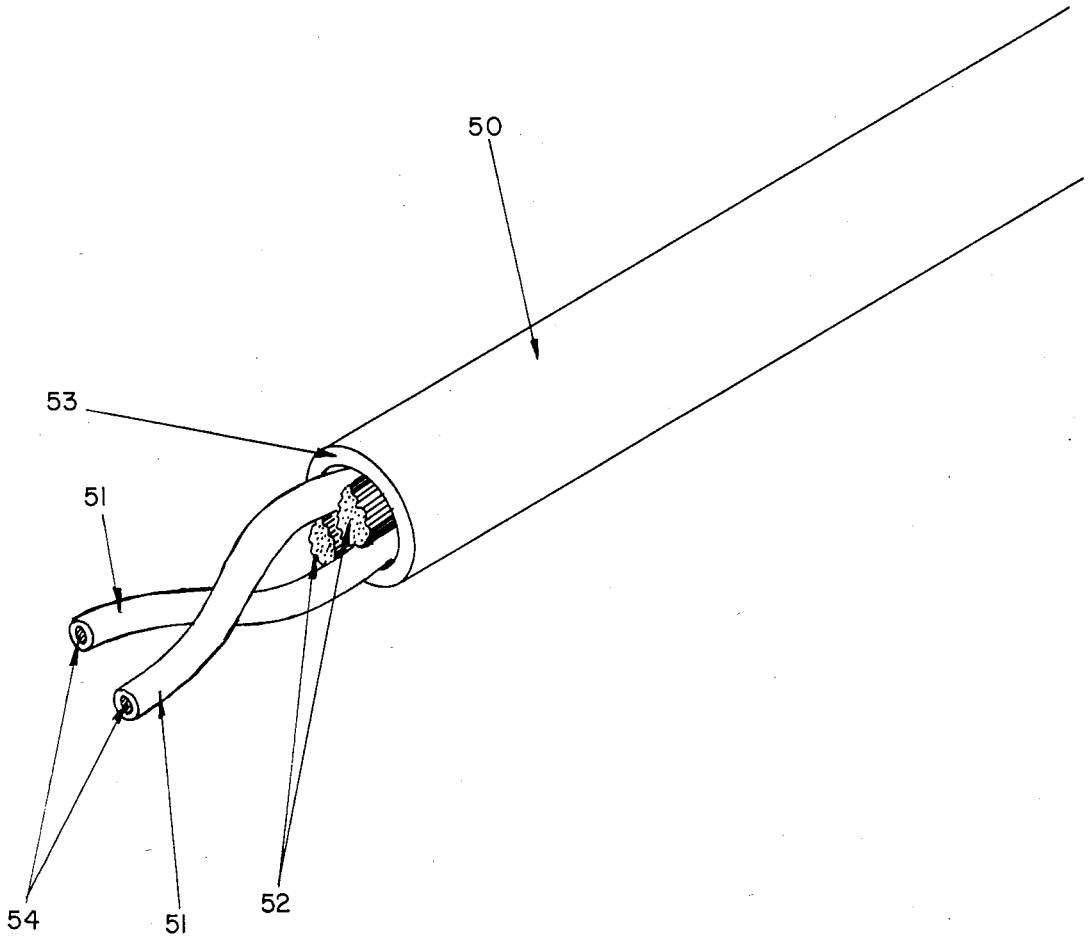
FIG. 3D demonstrates an enlarged view of the cord after filler removal.

In FIG. 3B cord 50 has been rotated in a clockwise direction to expose additional areas of filler 52 approximately as designated in area 62 before degradation of filler 52 has begun. The time lapsed may be only a few seconds between FIGS. 3A and 3B as the high temperature air quickly acts to destroy the structural integrity of polyproplene filler 52. Once the thin stream of hot air has melted and degraded filler 52 in a relatively narrow area (62), activating means 24 (as shown in FIG. 1) is depressed whereby an impulse of high pressure, somewhat cooler air exists nozzle lateral opening 14 to shear degraded filler 52 and to eject shards 55 as shown in FIG. 3C. Shards 55 strike the inside portion of debris gate 28 where they may remain until manually removed. In FIG. 3D the vinyl clad conductors 51 are shown with filler removed from between and conductors 51 can be further stripped to expose copper wires 54 for connection with appliances or the like.

Figure 4:
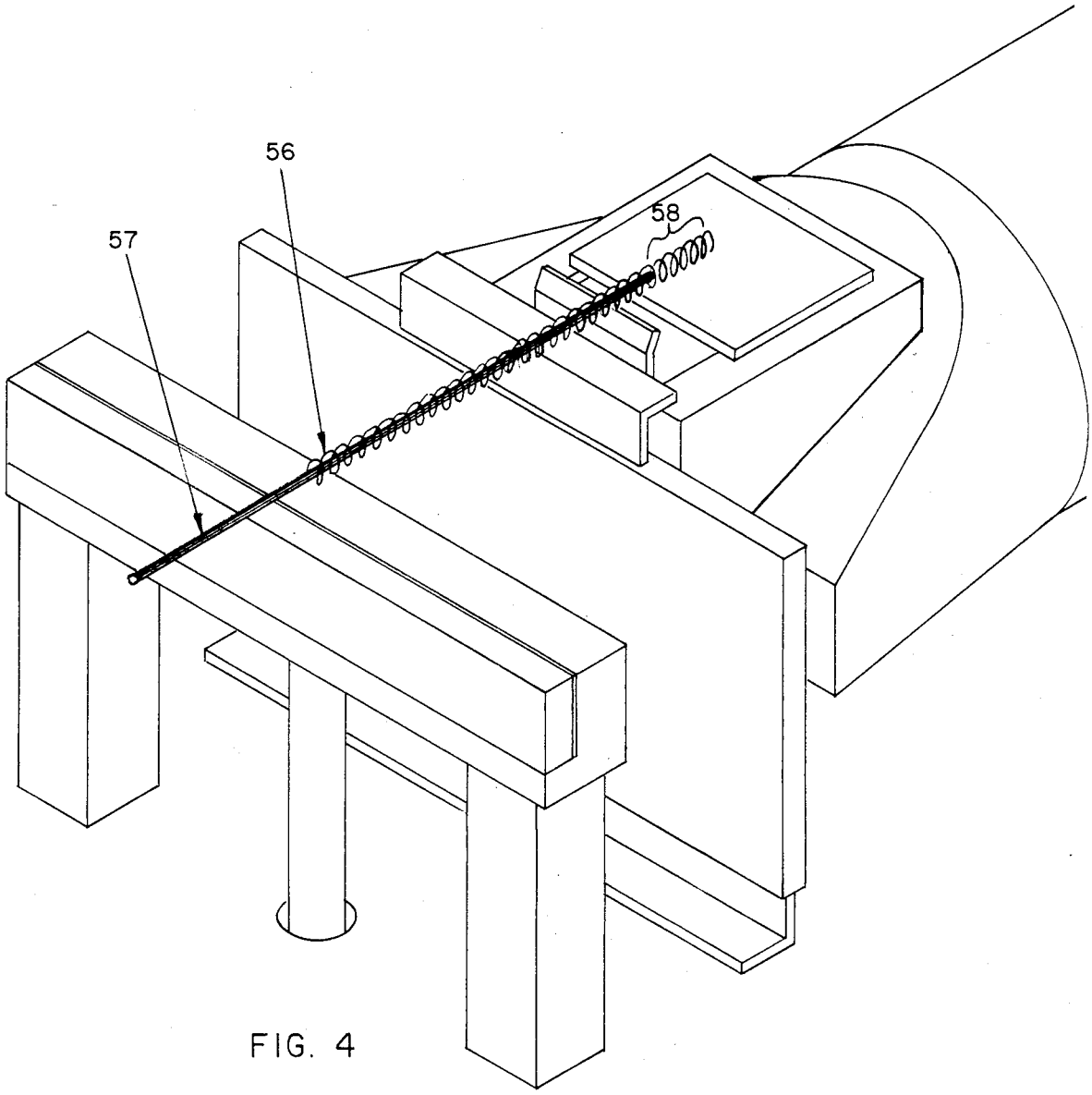
FIG. 4 illustrates a metallic coil wire with a filler through the center of the coil.

In FIG. 4 yet another type of wire, a metallic coil wire 56 is shown having a filler 57 therein. Configurations such as a metallic coil wire 56 in FIG. 4 may not require the pulse generator to remove the filler since the highly heated air may melt the filler sufficiently to remove it from the necessary area or length 58 as shown in FIG. 4.

Various modifications and changes can be made to the invention shown herein by those skilled in the art and the examples and illustrations presented are merely for explanatory purposes and not intended to limit the scope of the appended claims.

I claim:

1. A device for removing filler from cords comprising: air heating means, a nozzle, said nozzle communicating with said heating means, said nozzle defining an opening, said opening for providing a stream of hot air, nozzle opening adjusting means, said adjusting means positioned on said nozzle, cord guiding means, and said cord guiding means positioned in juxtaposition to said opening.

2. A device for removing filler from cords as claimed in claim 1 including a fluid pulse generator, said generator communicating with said nozzle for supplying pressure fluid pulse thereto.

3. A device for removing filler from cords as claimed in claim 2 and including fluid pulse generator activating means, said activating means joined to said fluid pulse generator.

4. A device for removing filler from cords comprising air heating means, a nozzle, said nozzle communicating with said heating means, said nozzle defining an opening, said opening for providing a stream of hot air, a safety housing, said housing positioned over said nozzle opening, cord guiding means, said cord guiding means positioned in juxtaposition to said opening.

5. A device for removing filler from cords comprising: air heating means, a nozzle, said nozzle communicating with said heating means, said nozzle defining an opening, said opening for providing a stream of hot air, nozzle opening adjusting means, said adjusting means positioned on said nozzle, a fan, said fan for directing air through said heating means and said nozzle opening, cord guiding means, said guiding means positioned in juxtaposition to said nozzle whereby cord filler positioned on said guiding means will be degraded by hot air passing through said nozzle.

6. A device for removing filler from cords as claimed in claim 5 wherein said nozzle defines a thin lateral opening.

7. A device for removing filler from cords as claimed in claim 5 and including hand resisting means, said hand resting means affixed proximate said nozzle.

8. A device for removing filler from cords as claimed in claim 5 and including a pulse generator, said generator communicating with said nozzle to supply high pressure air through said nozzle.

9. A method of removing filler from cords comprising the steps of:

(a) removing a section of the outer sheath from the cord, (b) directing heated air through an opening of a nozzle, (c) placing the cord section with the outer sheath removed in the heated air as it passes from the opening, (d) rotating the cord, and (e) destroying the structural integrity of the filler with the heated air.

10. A method as claimed in claim 9 wherein the step of placing a cord having filler in the heated air comprises placing a cord having a synthetic material as the filler in the heated air.

11. A method as claimed in claim 9 wherein the step of detroying the structural integrity of the filler comprises melting the filler.

12. A method as claimed in claim 9 and including the step of subsequently directing a pulse of high pressure air through the nozzle opening after the structural integrity of the filler has been destroyed.

13. A method as claimed in claim 12 wherein the step of directing a high pressure pulse of air comprises directing a pulse of air of approximately 5 to 100 psi through the nozzle opening.

14. A method as claimed in claim 9 wherein the step of directing heated air through a nozzle comprises directing air heated to approximately 200°-700° C. through the nozzle opening.

* * * * *